US006537112B1

(12) United States Patent
Striebig et al.

(10) Patent No.: US 6,537,112 B1
(45) Date of Patent: Mar. 25, 2003

(54) CONTACT MOUNT STRIP AND PROCESS FOR SEVERING A CONTACT HELD ON SAID STRIP

(75) Inventors: Jean-Louis Striebig, Ormesson (FR); Jerome Fortin, Sarge les le Mans (FR); Yann Herrouin, Saint-Maur des Fosses (FR); Sylvain Gault, Bailly-Romainvilliers (FR); Gilbert Spinnato, Bois d'arcy (FR)

(73) Assignee: Framatome Connectors International (FR)

( * ) Notice: Subject to any disclaimer, the term of this patent is extended or adjusted under 35 U.S.C. 154(b) by 0 days.

(21) Appl. No.: 09/617,702

(22) Filed: Jul. 17, 2000

(30) Foreign Application Priority Data

Jul. 20, 1999 (FR) ..... 99 09394

(51) Int. Cl.[7] ..... H01R 13/02
(52) U.S. Cl. ..... 439/885; 439/884; 439/745
(58) Field of Search ..... 439/884, 885, 439/745

(56) References Cited

U.S. PATENT DOCUMENTS 4,369,572 A * 1/1983 Atkins ..... 29/879
4,428,642 A * 1/1984 Schwindt et al. ..... 439/885
4,687,267 A * 8/1987 Header et al. ..... 439/62
5,094,636 A 3/1992 Zinn et al. ..... 439/839
5,190,486 A * 3/1993 Tsuk ..... 439/886
5,456,616 A 10/1995 Fuerst et al. ..... 439/620
5,974,768 A * 11/1999 Scholzke et al. ..... 53/399
6,159,049 A * 12/2000 Schramme et al. ..... 439/620

FOREIGN PATENT DOCUMENTS

DE 4340375 A1 6/1995
GB 2103433 A 2/1983

* cited by examiner

*Primary Examiner*—Tho D. Ta
(74) *Attorney, Agent, or Firm*—Perman & Green, LLP

(57) ABSTRACT

A strip (1) is described which includes a first device (5, 15) for temporarily holding a contact (2), and having a second device (26) for retaining the contact inside a tube. Provided with a clip (39) in such a manner that the contact is ready to be inserted in a receptacle of a connector. The strip allows the displacement of several grouped contacts, in a parallel arrangement on the strip. The strip is preferably displaced in coiled form, therefore having protection devices (41) to prevent the contacts from crushing over each other. Precut bridges (44) allow an easy separation of contacts surrounded by their respective clip from the strip.

8 Claims, 2 Drawing Sheets

CONTACT MOUNT STRIP AND PROCESS FOR SEVERING A CONTACT HELD ON SAID STRIP

BACKGROUND OF THE INVENTION

1. Field of the Invention

The present invention relates to a contact mount strip as well as to a process for severing a contact held on the strip. More particularly, it finds application in the automation of a process for mounting these contacts in a connector which has receptacles for accomodating each a contact, a socket or a pin. The contacts inserted in this kind of connector are sometimes miniature-sized and fragile. A strip according to the invention allows easy transportation of the contacts mounted on the strip, as well as safe mounting of contacts, particularly when the latter are miniature-sized.

2. Description of Prior Developments

In prior art, from document U.S. Pat. No. 5,456,616 the existence of bandoliers is known from U.S. Pat. No. 5,456,616. These bandoliers (preferably shaped rather than cut out) are designed to support and. transport contacts in a typically coiled strip. In this manner, on the one hand, contacts are delivered more easily, without interlocking, and on the other hand, the introduction of contacts in connector receptacles may be more effectively automated, thanks to the provision of a standard spacing therebetween. These bandoliers are particularly designed for displacing miniature contacts. A bandolier has contacts in the same parallel arrangement as required for insertion in a connector. To this end, a connector receiving this type of contacts has several paralleled receptacles. This bandolier, which is provided in coiled form, is less space-requiring during transportation. Thanks to this bandolier, miniature contacts may be massively transported from a manufacturing site to an operating site. During transportation, the contacts mounted on the bandolier are protected from impacts and maintained intact, which cannot be ensured when bulk contacts are transported.

Prior art miniature contacts, which are to be mounted in connector receptacles, typically have a generally cylindrical shape. The receptacles for receiving these contacts also have a cylindrical shape. A diameter of a receptacle is such that it can only receive a single contact. However, a diameter of a receptacle is slightly greater than a diameter of a contact. Hence, a contact inserted in its receptacle slightly floats therein. Therefore, in order that the contact might be retained in its receptacle in prior art, a retaining member is used around the contact. This retaining member is, as known, a retaining clip. The retaining clip has jaws spaced apart slantwise with respect to the contact, and these jaws may be temporarily snapped against the contact, to be restored in their spaced apart condition when the snapping stress stops. The retaining clip is mounted around the contact before insertion of the contact in its receptacle. Then, the ends of the jaws of the retaining clip interact with a release in the inner walls of the receptacle.

Additionally, in the prior art, contact bandoliers are known, i.e. coiled strips which only have retaining clips. In the mounting step, the retaining clips are severed from the coiled strips, to be mounted on the contacts. Further, the contacts so equipped, each surrounded by a retaining clip, are inserted in connector receptacles.

In the prior art, positioning a contact inside a connector receptacle involves a problem. Such positioning is not immediate and requires a number of operations, particularly providing contacts with retaining clips or previously positioning such retaining clips in the receptacles before positioning contacts. Further, in order to mount such a contact, two kinds of intermediate bulky elements are needed, on the one hand a bandolier for contact support and on the other hand a strip of retaining clips. A further drawback of the prior art consists in that this process for positioning a contact inside a connector generates two waste types: empty bandoliers, whose contacts have been severed and empty strips, whose retaining clips have been removed. Also, these two intermediate objects are two separate elements to be supplied and stocked in equal amounts at the connector assembly site. Errors might occur if different contact formats and retaining clip formats are available.

SUMMARY OF THE INVENTION

The invention has the object to solve the above problems by providing a single strip which has, on the one hand a first means for holding a contact on said strip, and on the other hand a second means for also holding the contact on said strip and simultaneously forming a retaining clip around the contact. The first means has the main function, like in prior art, to hold the contact on the strip when the strip is transported. The second means surrounds the contact and forms a clip which acts as a retaining member. In the invention, the second means, said clip, may be severed from the strip. When the clip is severed from the strip, the contact remains inside the second means, whereby it is still fitted with the clip. The clip, formed by the second means around the contact acts as a contact retaining member, when the contact is inserted in a connector receptacle. Then, the clip wrapped around the contact interacts with the inner walls of the receptacle. Preferably, the clip is severed after transportation of the bandolier, upon insertion of the contact in its receptacle.

Therefore, the solution provided by the invention is such that a single strip is provided, also able to be coiled, that the contact is mounted in the first means and in the second means simultaneously and that mounting of the contact, fitted with its clip, in a connector receptacle may be automated. Further, a single strip is provided, which forms the only waste resulting from mounting of contacts in connector receptacles. Additionally, no inventory error may occur.

Then, the invention relates to a contact mount strip, including a first device for temporarily holding a contact, and a contact supported in such first device, characterized in that it includes a second retaining device which forms a retaining clip around a section of the contact.

The invention also relates to a process for severing a contact held in a clip of such a strip, characterized in that it includes the following steps:

- pivoting the contact about a perforated part, while pushing it through a cutout of the strip beyond a plane formed by said strip;
- thereby removing the contact from the first device for temporarily holding it by a rotary force;
- bending the perforated part through a sufficiently narrow angle to rupture the perforated part;
- disengaging the contact and the clip surrounding the contact from the cutout by a translational motion perpendicular to the plane of the strip.

BRIEF DESCRIPTION OF THE DRAWINGS

The invention will be understood more clearly by reading the following description and by analyzing the accompanying figures. The latter are only shown by way of example and do not intend to limit the invention in any manner. The figures show.

DESCRIPTION OF THE PREFERRED EMBODIMENTS

Figure 1:
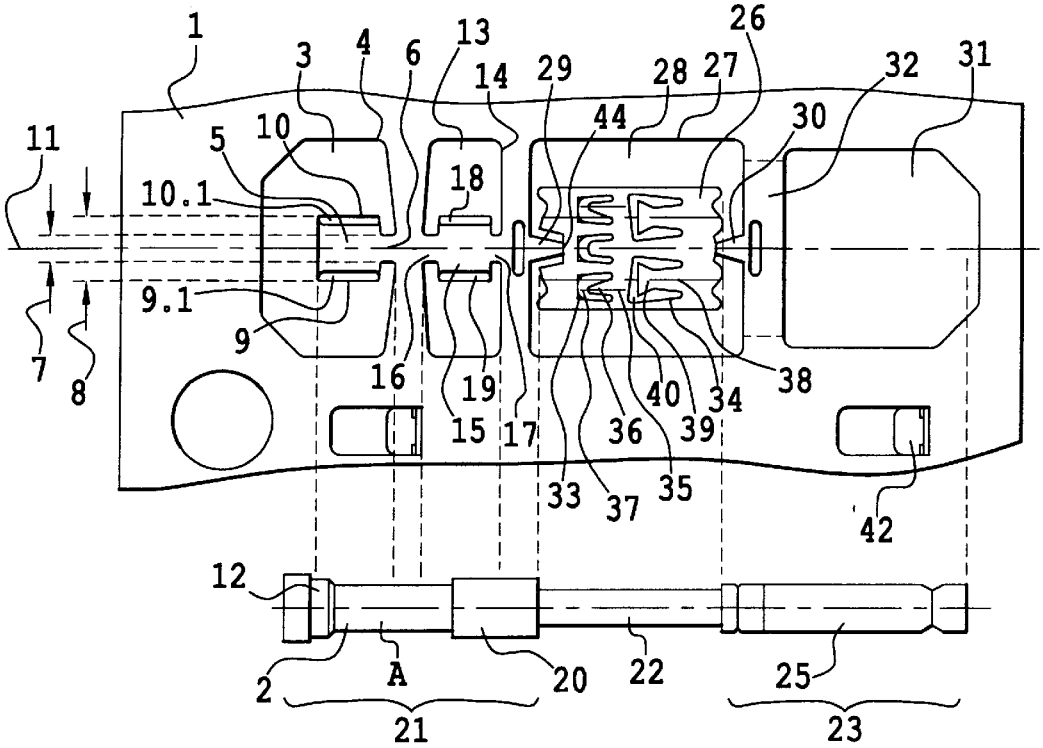
FIG. 1: a top view of a strip and a contact in accordance with the invention before mounting the contact on the strip.

FIG. 1 shows a part of the strip 1 of the invention, corresponding to a contact location. This part of the strip 1 is designed to receive a contact 2. The strip 1 has a first cutout 3. The first cutout 3 is made according to a first perimeter 4, particularly by die stamping. The strip 1 has a first temporarily holding device cut out in the strip and particularly shaped according to the first cutout 3. After shaping, said first device has a substantially rectangular and flat blade 5. The blade 5 is defined in the same plane as the one formed by the strip 1. Before mounting a contact on the strip, the blade 5 defined by the perimeter 4 is aligned in the direction of the strip 1. The blade is linked to the strip 1 on the perimeter 4 by a foot 6. The foot 6 has a width 7. The first device has a width 8. The width 8 is greater than the width 7.

The first device may be shaped by bending the flanks 9 and 10 of the blade 5 perpendicular to the plane of the strip 1 and by providing them with a substantially cylindrical shape. The flanks 9 and 10 are symmetric with respect to a plane of symmetry 11 which cuts the foot 6 at its center, perpendicular to the strip 1. The plane 11 is also preferably a plane of symmetry of the first cutout 3. In order to cover a first section 12 of the contact 2, the flanks 9 and 10 may be provided with curved tips 9.1 and 10.1, at the ends of the blade 5 respectively. As a variant, the flanks 9 and 10 are slightly inclined towards each other. The width 8 and the height of the flanks 9 and 10 are such that the flanks 9 and 10 cannot wholly encircle the circumference of a truncated cylinder formed by the first section 12. The section A forms a hollow stem for receiving an electric wire, e.g. welded or crimped thereto.

In a preferred embodiment of the invention, the first device includes a second cutout 13 in the strip 1. The second cutout 13 has a periphery 14. The second cutout 13 allows to form a second blade 15. The blade 15 is linked to the strip 1 by a first foot 16 and a second foot 17. The plane of symmetry 11 passes through the center of the feet 16 and 17. The blade 15 has a first flank 18 and a second flank 19. The flanks 18 and 19 are symmetrical with respect to the plane 11. They are not linked to the periphery 14 of the second cutout 13. Therefore, like the flanks 9 and 10, the flanks 18 and 19 may be shaped. Preferably, the flanks 18 and 19 are raised perpendicular to the strip 1, on the same side, with respect to the plane formed by the strip 1, as the flanks 9 and 10, and are provided with a substantially cylindrical shape. The flanks 18 and 19 are then raised so that they may encircle a second section 20 of the contact 2. In one embodiment, the second section 20 of the contact 2 has the same diameter as the section 12. Further, the flanks 18 and 19 are such that they do not allow to fully encircle the circumference of a truncated cylinder formed by the second section 20. They may be provided with curved tips.

The first blade 5 and the second blade 15 so formed constitute a support for the contact 2 on the strip 1, which is thereby held with a controlled clearance. The obtained blades form two open elastic clamps. When a contact 2 is to be mounted on the strip 1, then the contact 2 is slid into the two elastic clamps. The clamps are such that they encircle the contact 2 substantially over a first third 21 at a first end of the contact 2. The contact 2 has an elongate structure with a central section 22. Said central section 22 is situated on an axis which defines the elongation of the contact 2. Depending on this longitudinal axis, the contact 2 includes, substantially over another third, at a second end thereof 23, a pin (not shown) or a socket 25. The socket 25 (or the pin) is designed to form, in a connector wherein the contact 2 is mounted, an accessible part of the contact 2 to be put in contact with a complementary contact of a complementary connector. In practice, the first section 12 is forcibly inserted between the flanks 9 and 10 and 18 and 19, which hold it against the strip 1. The elasticity of the flanks is sufficient to hold it with a certain clearance. The central section 22 may have a smaller diameter, particularly to receive a retaining member, i.e. a retaining clip.

In the invention, the contact 2 is retained on the strip 1 at the end 21, which has no part to be connected to a complementary contact. In fact, the first blade 5 and the second blade 15 might locally deteriorate the outer surface of the contact 2. However, since the stem A is designed to receive a conductor of a cable therein, an outer surface of the stem A may be slightly scratched with no damage risk. In the invention, the contact is held against the strip 1 by an end 21, which is the last to be inserted in a connector. As will be apparent below, the strip will paradoxically keep on having its retention role during mounting.

A bandolier according to the invention, fitted with its contacts, preferably has contacts all of the same type. However, there will only be provided one kind of contact mount strip, regardless of their being male or female contacts. The different part of a contact, according to its being male or female, is not held by the strip 1.

In the invention, the strip 1 includes a second device 26 to be shaped. The second device 26 is a retaining device. It is formed by a third perimeter 27 of a third stamped cutout 28. The device 26 is linked to the strip 1 by a third foot 29 and a fourth foot 30. Therefore, die stamping is effected in two symmetric parts. Preferably, the feet 29 and 30 have a trapezoidal shape, with a large and a small base. Preferably, small bases are embrittled from the start by perforations, e.g. all over their length. The plane of symmetry 11 is also a plane of symmetry of the second device 26. The plane of symmetry 11 passes through the third and fourth feet 29 and 30.

Further, the strip 1 has a fourth cutout 31. The fourth cutout 31 is separated from the third cutout by a segment 32. The fourth foot 30 is linked to the strip 1 by this segment 32.

The strip so equipped is carried towards the mounting site. Later, at the mounting site, the segment 32 is separated from the strip 1, for instance by shearing it. Then, the segment 32 and the fourth foot 30 are removed, particularly by twisting both about the small base of the foot 30. So, the third cutout 28 will communicate with the fourth cutout 31. This overall cutout is such that it extends beyond the end of the section 23 of the contact 2.

Preferably, the second retaining device is formed prior to contact introduction. Therefore, preferably, in order to mount the contact 2 on the strip 1, the contact is slid through the two devices, already shaped, until the section 12 abuts against the blade 5. According to a variant, the second device may be formed around the central part 22 of the contact, after or upon mounting the contact 2 on the strip 1 in the supports 5 and 15. In accordance with another variant, the contact 2 may be mounted on the strip 1 also by wrapping the flanks 9 and 10 around the first section 12 of the contact 2, and by wrapping the flanks 18 and 19 around the second section 20 of the contact 2, then by covering the central connecting section 22 with the second device 26. Typically, the second device 26 fully covers the connecting section 22. In another embodiment of the invention, the contact 2 may be first inserted in the first temporarily retaining device, then the second device only is shaped directly around the contact 2.

The cutouts 3, 13, 28 and 31 are made along the plane 11. The plane 11 passes through the center of the foot 6 and of the feet 16, 17, 29 and 30. The contact 2 is laid over the devices 5 and 26 of the strip 1, so that the longitudinal axis of the contact 2 overlaps the axis 11.1.

The second device 26 covers the connecting section 22 as effectively as possible over the whole circumference and length thereof. At this location, it forms a tube around the contact 2. The second device 26 includes a first series 33 of holes and a second series 34 of holes. The holes are obtained by stamped cutouts in the strip 1. There are preferably provided three holes in the first series and two holes in the second. These series of holes are aligned in the direction of the strip 1. The series of holes are designed to act as series of elastic devices. A first elastic device 35 of the first series 33 of holes has a tab 36. The tab 36 is flexible inside a hole 37 of the first elastic device 35. Before mounting the contact 2 on the strip 1, the tab 36 is preferably bent towards a second side of the plane formed by the strip 1. The second side is opposite to the one whereon the flanks 9 and 10 and the flanks 18 and 19 are formed. A second type of elastic device 38 may be obtained from the series 34 of holes. Here, the elastic device 38 consists of a flexible wing 39 inside a hole 40 of the second device 38. Before mounting, the wing 39 is bent outwardly with respect to the strip 1, on the same side as the tab 36.

The contact 2 is mounted in the second device 26 in such a manner that the tabs 36 and the tongues 39 increasingly widen around the central part 22 from the end 23 to the end 21. The tabs 36 and the wings 39 are compressible along a section formed by the central connecting section 22 of the contact 2. Therefore, when a contact 2, surrounded by the tube formed by the second device 26 is introduced in a connector receptacle (with the end 23 ahead), the tabs 36 and wings 39 fold down along the contact 2. The introduction being completed, the wings 39 act as a non-return clip when the contact 2 is inserted in a connector receptacle, and turn back to their widened state in a wider cavity of said receptacle. Hence, they prevent any withdrawal of the contact 2 from the connector wherein the contact 2 has been introduced. The wings 39 widen in such a manner that their ends may abut against a release of an inner wall of a receptacle of this connector. The tabs 36 are in regular arrangement over the periphery of the central connecting section 22. The tabs 36, also widened with respect to the connecting section 22, act as a centering device for the contact 2 in its receptacle. For this reason, they are preferably three in number.

The strip 1 has several contacts like the contact 2. The contacts are disposed, like the contact 2, in devices like the devices 5, 15 and 26. The strip 1 has contacts in parallel arrangement. The strip 1 with the contacts may be coiled. A coiling axis for this strip is typically parallel to an axis such as the one passing through the plane 11 defined for the contact 2. Anyway, the coiling radius cannot be too small.

Figure 2:
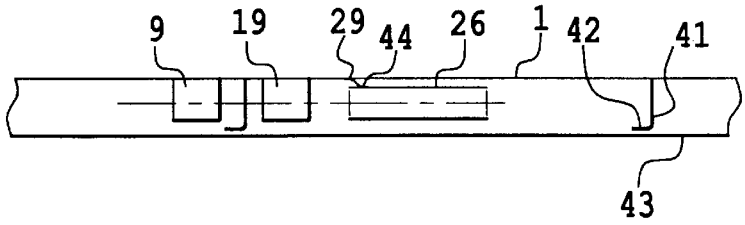
FIG. 2: a cross section of a strip equipped according to the invention.

In order to prevent the contacts supported by the strip from crushing when two turns of the strip coil superpose, the strip 1 includes at least one third protection device 41, as shown in FIG. 2. The third device 41 is a spacer block. A block of the third device 41 raises perpendicularly to the plane formed by the strip 1. The block has a backward extension 42. The backward extension 42 is parallel to the plane formed by the strip 1. In a preferred embodiment of the invention, the strip 1 has two spacer blocks like the block 41 for contact support. These two blocks are disposed along an axis parallel to the plane 11. The spacer blocks 41 raise on the same side of the plane formed by the strip 1 as the side whereon the devices 5, 15 and 26 are formed. The spacer blocks are disposed between two consecutive contacts.

For an enhanced protection of the contacts supported by the strip 1, a protection sheet 43 is laid over the backward extensions 42 of the spacer blocks 41, particularly upon coiling. Hence, the protection sheet 43 is coiled parallel to the strip 1. The height of the blocks 41 is such that the protection sheet 43 does not touch the contacts supported by the strip 1.

In FIG. 1, the foot 29 has a perforated part 44 therein. Hence, when a contact 2 is mounted in a second device 26, after removing the segment 32 and the foot 33, the second device 26, with the contact 2 surrounded thereby may be severed from the strip 1. In a preferred embodiment of the invention, a pin (not shown) is inserted in the stem A to sever the contact 2 from the strip 1. So, the contact may be pivoted about a pivot point situated at the perforated part 44, by using the pin as a lever arm. This movement allows to remove the contact 2 from the elastic clamps 5 and 15, and to rupture the connection at the perforated part 44. Finally, the contact 2 held on the pin may for instance be laid on a positioner allowing, after withdrawal of the pin, to put a conductor strand at the right place and to crimp the contact and the conductor strand together. Then, the contact may be handled through the conductor strand and be placed in a corresponding receptacle of a connector.

Figure 3:
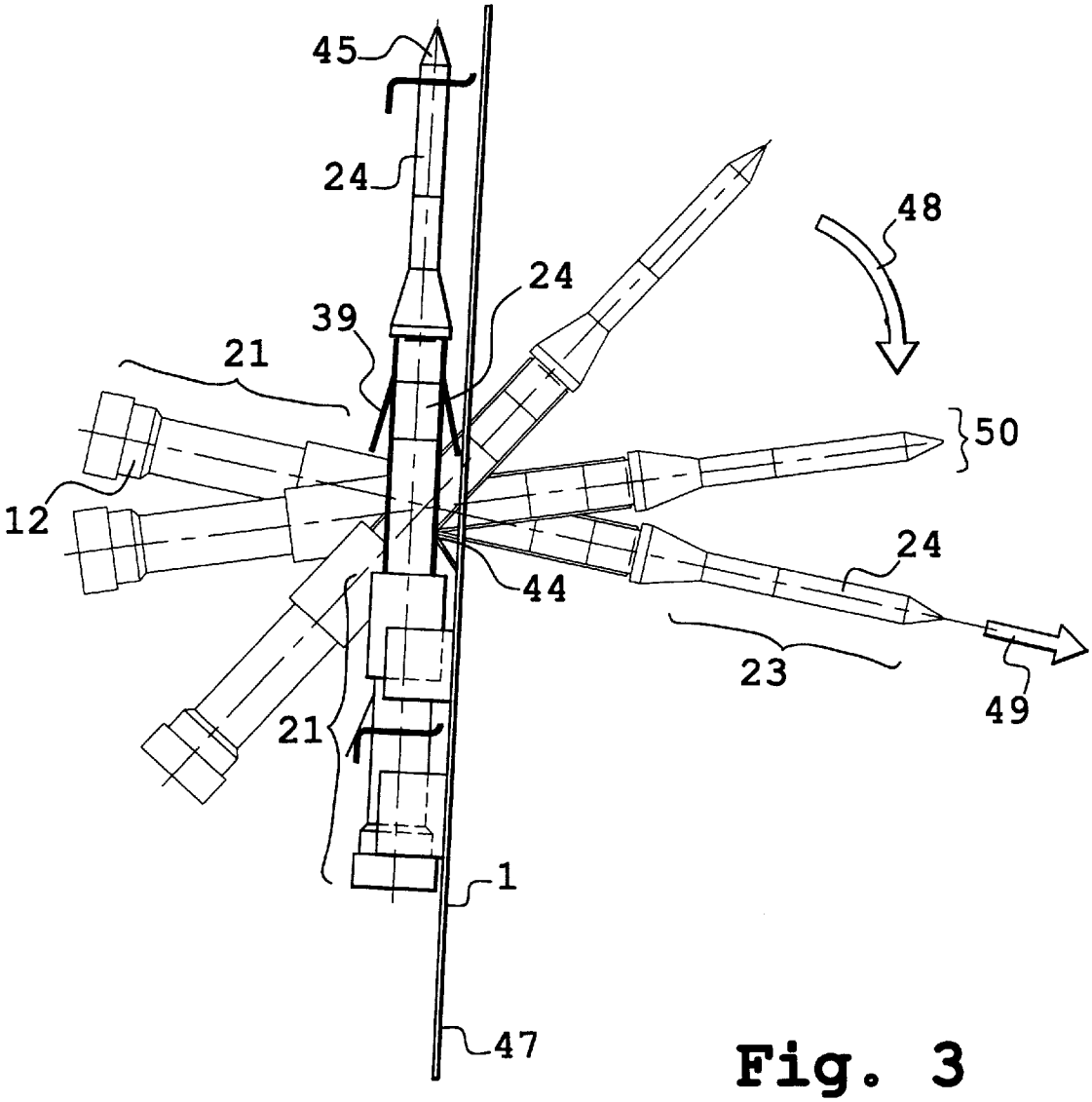
FIG. 3: a sectional view with time of the process for severing a contact from a strip according to the invention.

In one variant, a contact 2 may be severed from a strip 1 by pressing on the second end 23 of the contact 2. The second end 23 is opposite to the first end 21. FIG. 3 shows a male contact 2 whose second end 23 has a pin 24. The principle wherewith a contact 2 is severed from a strip such as the strip 1 is identical regardless of whether the end 23 has a socket 25 or a pin 24 situated at the second end 23.

In order to sever a contact from a strip, the contact 2 is oscillated about a pivot point at the perforated part 44. In this manner, the contact 2 crosses a plane 47 of the strip 1. It turns in the direction of the curved arrow 48. To cross the plane 47, the contact 2 passes through the common opening of the third and fourth cutouts 28 and 31. The first and second sections 12 and 20 of the contact 2, held by the flanks 9 and 10 and by the flanks 18 and 19 come out of these elastic support clamps. The contact 2 is oscillated about the pivot point through a sufficient angle, here for instance above 90°, so as to rupture the perforated part 44. Then, the contact 2, still fitted with the clip formed by the second device 26 is disengaged, and this assembly passes completely through the common opening of the third and fourth cutouts 28 and 31. This displacement is effected by a translational motion 49 wherein the pin 24, or the socket 25, as the case may be, is in the front position.

The assembly is disengaged from the strip 1 by a translational motion generally perpendicular to the plane 47. This releases a contact 2 with its clip, ready to be inserted in connector receptacle. If needed, several pins 24 or sockets 25 of a strip section may be simultaneously engaged in a connector, while they take an intermediate pivoting position

50, between the one wherein they are held on the strip 1 and the one wherein the connecting part 44 is ruptured. This is obtained by rotating a strip section with the contacts to be inserted. Such operation is perfectly fit for automation. Once the insertion is completed, the wings 39 prevent withdrawal from the insertion side. Possibly, the rupture of the perforated part 44 occurs when the wings 39 are locked inside the receptacles.

The strip 1 allows displacement of contacts from one location to the other, while providing these contacts with a retaining clip, which is required for them to be held in a connector receptacle.

What is claimed is:

1. A contact mount single strip, including a first retaining device for temporarily holding a contact on the strip, the contact being supported in the first device, and a second retaining device for also holding the contact on the strip and simultaneously adapted to form a retaining clip around a section of the contact, the contact being mounted in the first and second device simultaneously and the contact being made ready to be inserted in a receptacle of a connector and the retaining clip performing as a contact retaining member to prevent any withdrawal of the contact from the connector receptacle when the contact is inserted in the connector receptacle.

2. A contact mount strip as claimed in claim 1, wherein said first device includes two open elastic clamps partly surrounding the contact at a first end thereof.

3. A contact mount strip as claimed in claim 1, wherein said first device and said second device are formed on the same side with respect to a plane of said strip.

4. A contact mount strip as claimed in claim 1, including a perforated part, said clip and said contact contained in said clip adapted to be severed from said strip.

5. A contact mount strip as claimed in claim 1, wherein further including a third protection device, consisting of at least one spacer block.

6. A contact mount strip as claimed in claim 5, whereby said third device is formed on the same side as said first device and as said second device, with respect to plane of said strip.

7. A contact mount strip as claimed in claim 1, wherein said strip is coiled.

8. A contact mount strip as claimed in claim 7, wherein an overlying protection sheet is disposed parallel to said strip and preferably rests against said third device.

* * * * *